US006986639B2

(12) United States Patent
Teramura et al.

(10) Patent No.: US 6,986,639 B2
(45) Date of Patent: Jan. 17, 2006

(54) STATOR BLADE FOR AN AXIAL FLOW COMPRESSOR

(75) Inventors: Minoru Teramura, Wako (JP); Junji Takado, Wako (JP); Gensuke Hoshino, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 174 days.

(21) Appl. No.: 10/636,622

(22) Filed: Aug. 8, 2003

(65) Prior Publication Data

US 2004/0141847 A1 Jul. 22, 2004

(30) Foreign Application Priority Data

Aug. 9, 2002 (JP) ..... 2002-232379

(51) Int. Cl.
*F03B 11/04* (2006.01)

(52) U.S. Cl. ..... 415/119; 415/208.2; 416/169 A

(58) Field of Classification Search ..... 415/119, 415/185, 191, 208.2, 199.5, 211.2; 416/169 A
See application file for complete search history.

(56) References Cited

U.S. PATENT DOCUMENTS

| | | | | |
|---|---|---|---|---|
| 5,192,190 | A * | 3/1993 | Ferleger et al. | 415/191 |
| 5,221,181 | A * | 6/1993 | Ferleger et al. | 415/181 |
| 5,292,230 | A * | 3/1994 | Brown | 416/223 A |
| 5,524,341 | A * | 6/1996 | Ferleger et al. | 29/889.7 |
| 5,947,683 | A * | 9/1999 | Kobayashi | 415/208.1 |
| 6,554,564 | B1 * | 4/2003 | Lord | 415/119 |

FOREIGN PATENT DOCUMENTS

JP 11-200808 7/1999

* cited by examiner

*Primary Examiner*—Edward K. Look
*Assistant Examiner*—Igor Kershteyn
(74) *Attorney, Agent, or Firm*—Squire, Sanders & Dempsey L.L.P.

(57) ABSTRACT

In an axial flow compressor, an apical angle at a leading edge of a stator blade progressively increases from a root end to a tip of the stator blade whereby the stator blade loss and noises caused by unsteady inter-blade airflow can be minimized. Preferably, the apical angle at the tip of the stator blade is 1.5 to 2.5 times of the apical angle at the root of the stator blade.

7 Claims, 6 Drawing Sheets

STATOR BLADE FOR AN AXIAL FLOW COMPRESSOR

TECHNICAL FIELD

The present invention relates to a stator blade for an axial flow compressor.

BACKGROUND OF THE INVENTION

An axial flow compressor comprises a plurality of rotor blades extending radially from a rotary hub, an outer casing surrounding the rotor blades defining a certain gap between the opposing tips of the rotor blades and the inner circumferential surface of the outer casing, and a plurality of stator blades extending radially inwardly from the inner circumferential surface of the outer casing immediately downstream of the rotor blades. See Japanese patent laid-open publication No. 11-200808.

In such an axial flow compressor, the kinetic energy of the rotor blades is converted into the kinetic energy of the fluid, thereby accelerating the fluid, and the stator blades located downstream of the rotor blades change the direction of the fluid flow, thereby decelerating and increasing the static pressure of the fluid. Therefore, to improve the efficiency of an axial flow compressor, it is necessary for the stator blades to be able to change the direction of the fluid flow with a minimum loss.

As the rotor blades rotate at a high speed and the tip of each blade moves along the inner circumferential surface of the outer casing defining a small gap between them, a highly complex flow pattern is generated near the tip of the rotor blade owing to the development of a surface boundary layer, generation of a shockwave, leaking of flow across the tip of the rotor blade and interferences of these flows. In particular, the interference between the leak flow produced between the tip of the rotor blade and the opposing inner circumferential surface of the outer casing and the shockwave produced between adjacent rotor blades produces a low momentum region having a certain circumferential expanse behind a rear half of each rotor blade (see FIG. 10). Furthermore, a trailing flow extending along the blade surface and having a limited circumferential expanse is generated at the outlet end of the rotor blade owing to the development of a surface boundary layer and occurrence of flow separation (see FIG. 11).

Because such a low momentum region and/or a trailing flow are produced cyclically, the flow between adjacent stator blades is prevented from becoming steady. In other words, to improve the efficiency of an axial flow compressor, it is necessary for the stator blades to be designed by taking into account not only the steady-state flow at the exit end of the rotor blades but also the non-steady-state flow in this region. Such a non-steady-state flow is a cause of noises.

BRIEF SUMMARY OF THE INVENTION

In view of such problems of the prior art, a primary object of the present invention is to provide a stator blade for an axial flow compressor that can reduce the blade loss.

A second object of the present invention is to provide a stator blade for an axial flow compressor that can reduce noises.

According to the present invention, at least one of these objects can be accomplished by providing a stator blade for an axial flow compressor having a rotor blade immediately upstream of the stator blade, wherein: an apical angle at a leading edge of the stator blade progressively increases from a root end to a tip of the stator blade. Here, the apical angle θ is defined as an angle formed by the positive and negative pressure surfaces at a 5% chord length position.

Thereby, the stator blade loss and noises caused by unsteady inter-blade airflow can be minimized. Preferably, the compressor is designed as a transonic axial flow compressor, and the apical angle at the tip of the stator blade is 1.5 to 2.5 times of the apical angle at the root of the stator blade. The apical angle may be given by $0.5H^{2+}1<\theta'<1.5H+1$, where $\theta'$=(apical angle/apical angle at the root) and H is a nondimensional position on the stator blade as measured from the root thereof, H=0 at the root and H=1 at the tip. Each of the rotor blades may be provided with aerofoil section.

When the compressor is designed as a transonic axial flow compressor, the apical angle may be between 5 and 15 degrees. When the compressor is designed as a subsonic axial flow compressor, the apical angle may be greater than 25 degrees.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
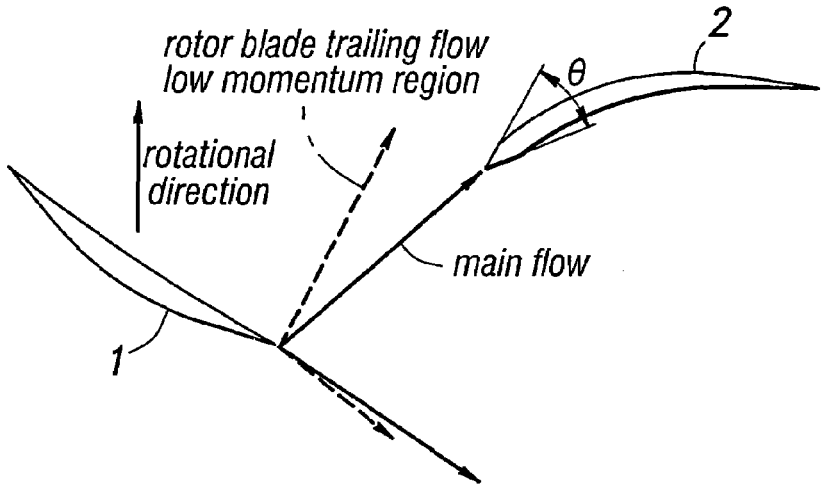
FIG. 1 is a diagram showing the airflow as it flows from the rotor blade exit to the stator blade entrance.
Figure 10:
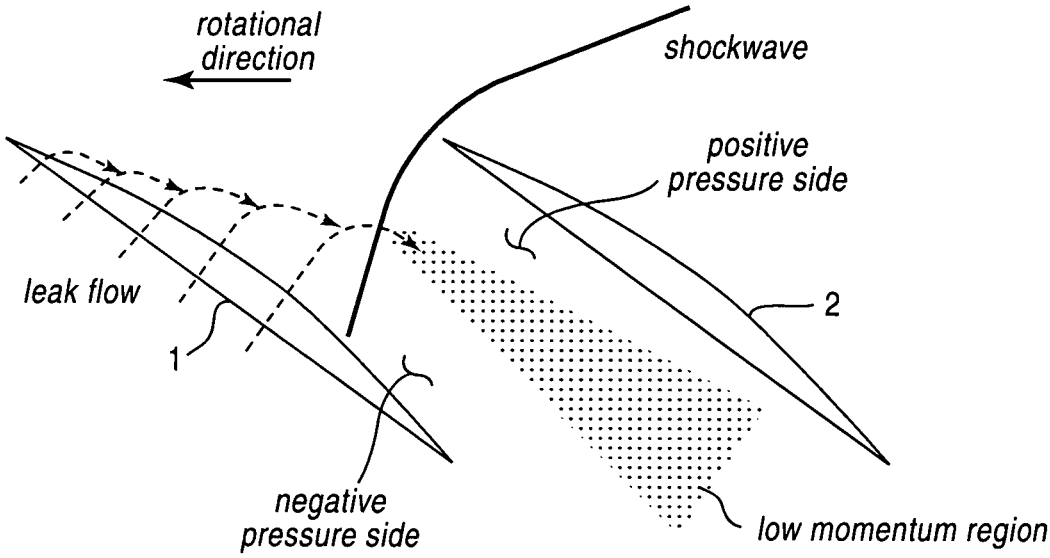
FIG. 10 is a diagram showing the state of airflow near the tip of the rotor blade.
Figure 11:
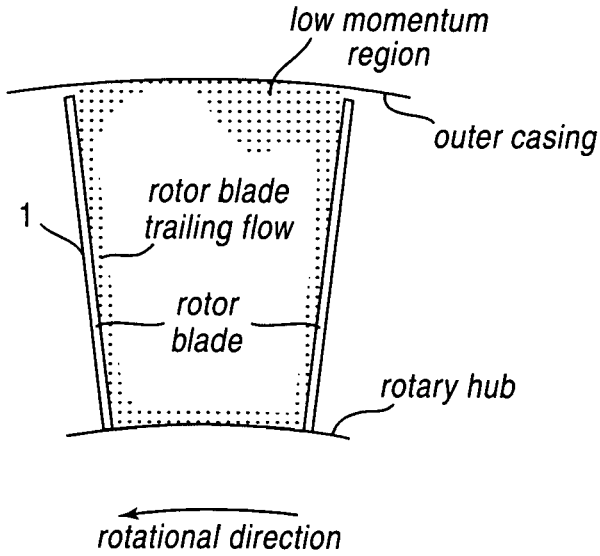
FIG. 11 is a fragmentary cross sectional view of the axial flow compressor showing the state of the rotor blade trailing flow and low momentum region.

FIG. 1 is a diagram showing the relationship between a rotor blade 1 and a stator blade 2 of an axial flow compressor. In an axial flow compressor, the low momentum region and the rotor blade trailing flow (see FIGS. 10 and 11) are produced that have relatively low speeds relative to the rotor blade 1, and relatively high entry angles relative to the stator blade 2. In other words, the flow through the space between the stator blades 2 tends to be unsteady because the low momentum region and the rotor blade trailing flow having a relatively large entry angle cyclically flow into the space between the stator blades in addition to the main flow having a relatively small entry angle. For such an unsteady flow to be mitigated, it is necessary to increase the resistance to the cyclic changes in the angle of the flow from the rotor blade exit flowing into the space between the stator blades (owing to the difference between the entry angle and the inlet angle of the space between the stator blades.)

The resistance to the changes in the entry flow angle can be increased by increasing the apical angle θ defined by the negative pressure surface and positive pressure surface of the leading edge of each stator blade. However, when the apical angle θ is increased, the curvature of the negative pressure surface has to be increased, and this promotes flow separation when the flow accelerates or decelerates. Conversely, when the apical angle θ is reduced, the entry angle of the low momentum region and trailing flow fail to match with the angle of the negative pressure surface and the resulting acceleration and deceleration at the leading edge of the negative pressure surface causes flow separation.

Figure 2:
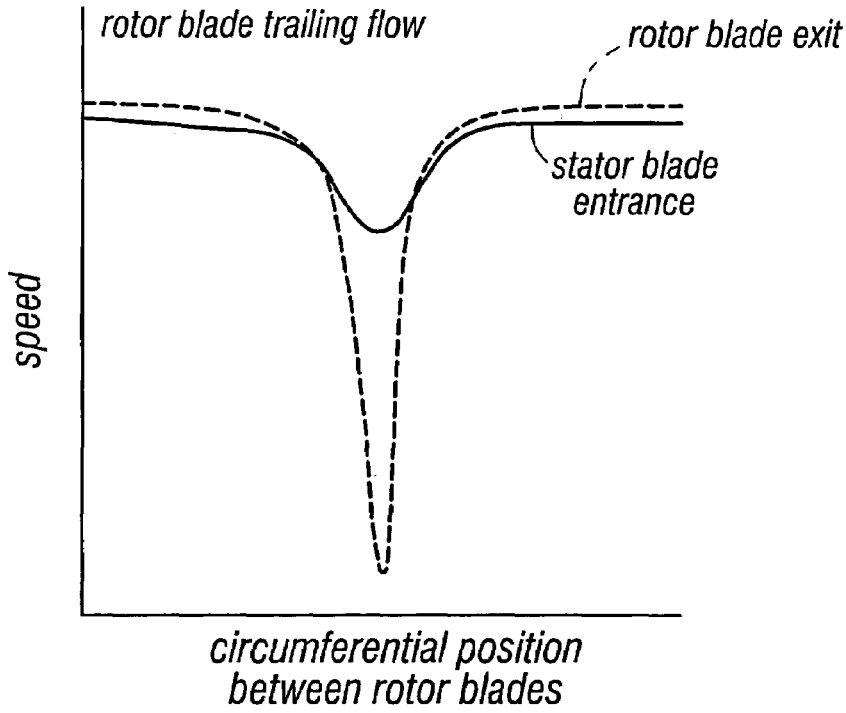
FIG. 2 is a graph showing the circumferential distributions of the speed of the rotor blade trailing flow at the rotor blade exit and stator blade entrance.
Figure 3:
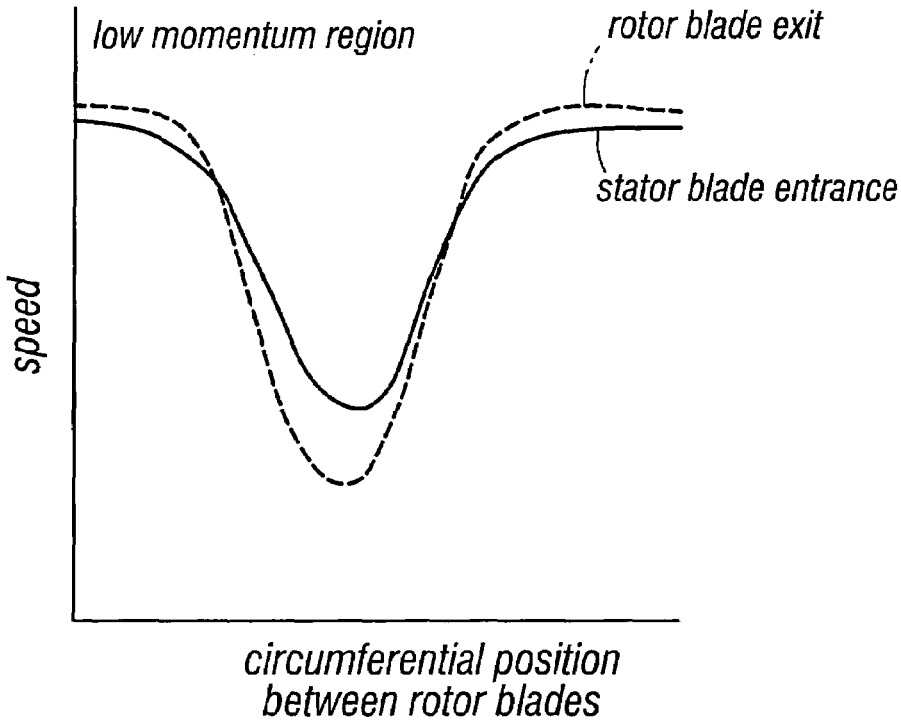
FIG. 3 is a graph showing the circumferential distributions of the speed of the low momentum region at the rotor blade exit and stator blade entrance.

The exit flow of the rotor blade forms a low momentum region that has a certain circumferential expanse near the radially outer end of the rotor blade 1, and a rotor blade trailing flow having a circumferentially narrow expanse flows out from a region extending from a radially intermediate part to the rotor blade root. The rotor blade trailing flow rapidly mixes with the main flow before reaching the stator blade inlet by virtue of a shear flow (see FIG. 2), but the low momentum region would not mix so well with the main flow (see FIG. 3), and this adds to the unsteady nature of the air flow between the stator blades.

In view of such problems of the prior art, according to the present invention, the apical angle θ of the leading edge of the stator blade is made relatively large in the tip region where a low momentum region having a relatively large circumferential expanse is present and the flow has a relatively unsteady tendency, and is made relatively small in the root region where the rotor blade trailing flow rapidly mixes with the main flow.

Figure 4:
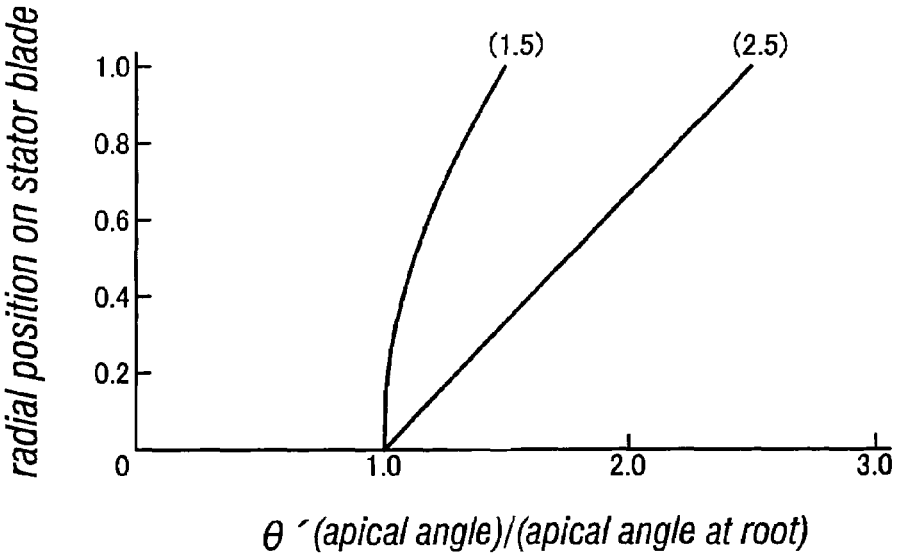
FIG. 4 is a graph showing the range of preferred relative apical angles in relation to the radial position on the stator blade.

More specifically, when an apical angle θ is defined as an angle formed by the positive and negative pressure surfaces at a 5% chord length position, the apical angle at the tip should be at least 1.5 times the apical angle at the root. The distribution of the nondimensional apical angle $\theta'$=(apical angle/apical angle at the root) in this case may be given by $\theta'=0.5H^2+1$. Also, the apical angle θ at the tip should be at most 2.5 times the apical angle at the root. The distribution of the nondimensional apical angle $\theta'$ in this case may be given by $\theta'=1.5H+1$. Here, H is a nondimensional radial position on the blade, H=0 at the root and H=1 at the tip. FIG. 4 shows a desired range defined the curves $\theta'=0.5H^2+1$ and $\theta'=1.5H+1$.

Figure 5:
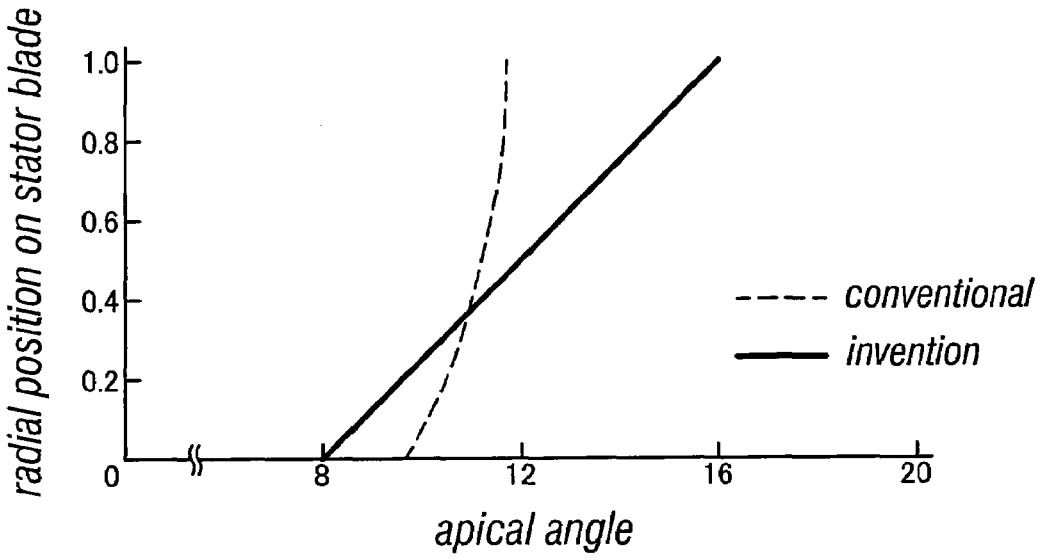
FIG. 5 is a graph showing exemplary distributions of the apical angle in relation to the radial position on the stator blade.
Figure 6:
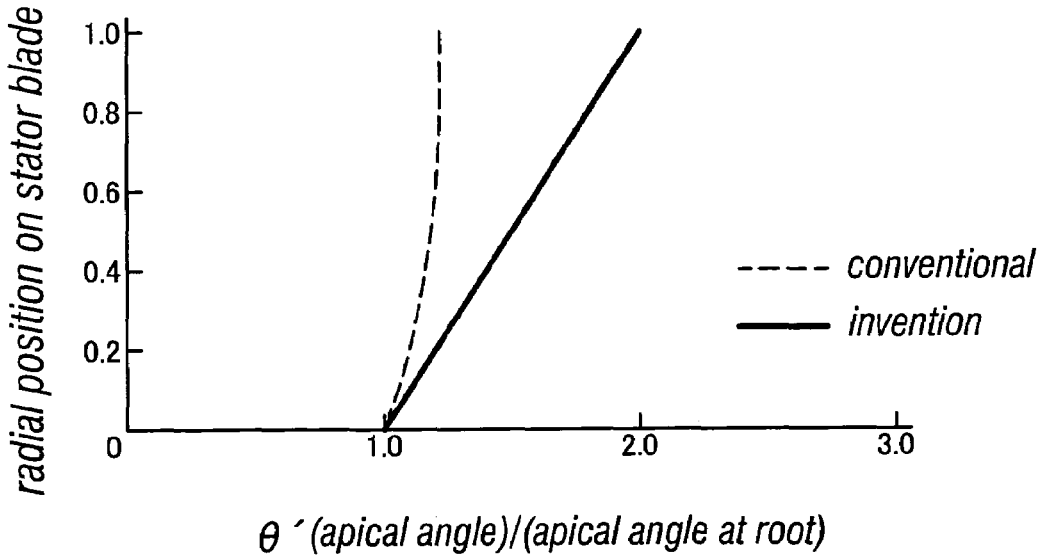
FIG. 6 is a graph showing exemplary distributions of the relative apical angle in relation to the radial position on the stator blade.

FIG. 5 shows an exemplary radial distribution of the apical angle of a stator blade 2 located downstream of a rotor blade 1 in a transonic axial flow compressor in which the relative Mach number of the inlet flow at the radially outer end of the rotor blade 1 is 1.5 and the gap between the tip of the rotor blade and the inner circumferential surface of the outer casing is 0.5% of the height (radial dimension) of the rotor blade 2. FIG. 6 shows the same distribution in a nondimensional form.

Figure 7A:
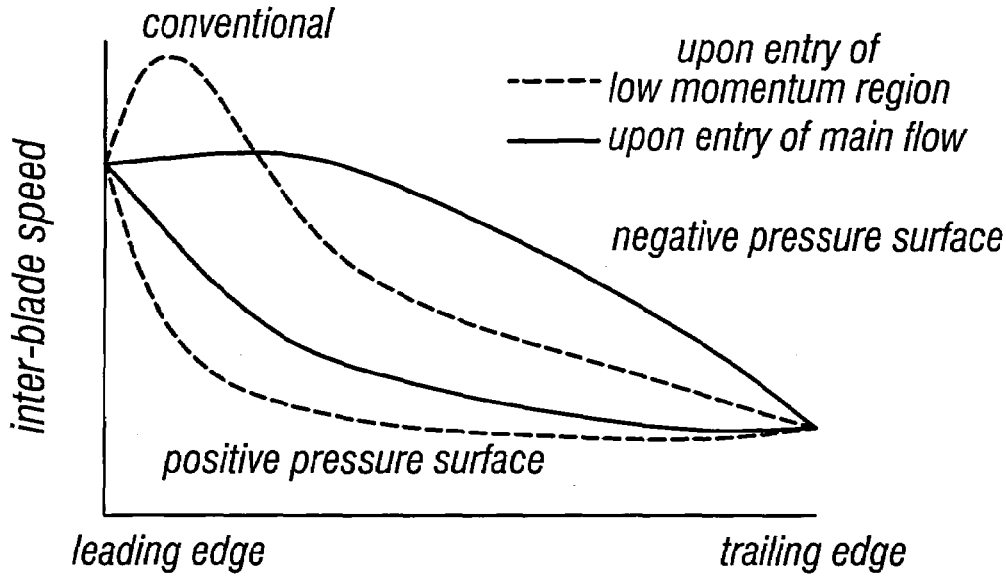
FIGS. 7*a* and 7*b* are graphs showing exemplary distributions of the inter-blade speed at various points on the stator blade according to the prior art and present invention, respectively.
Figure 7B:
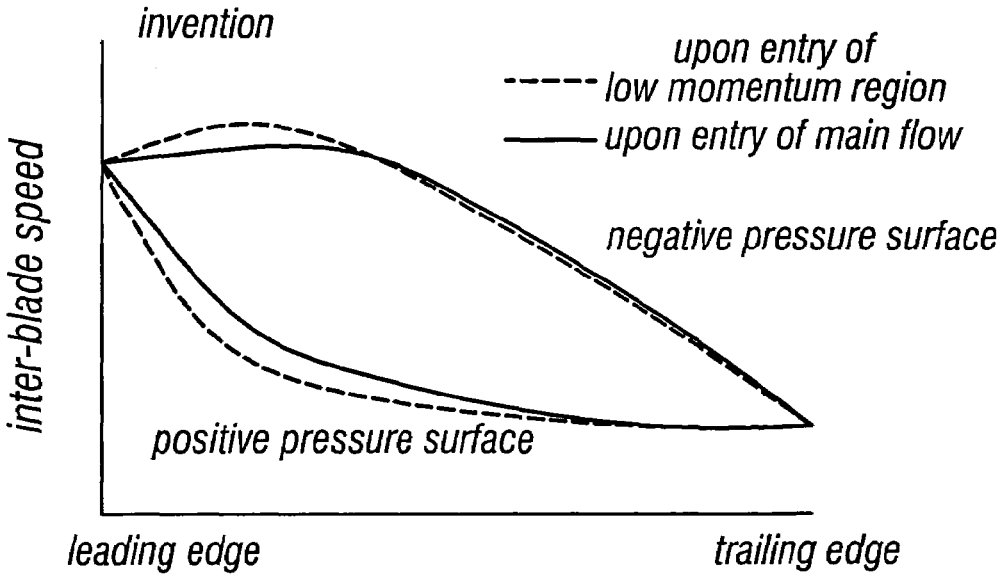

By thus progressively increasing the apical angle of the leading edge of the stator blade toward the blade tip, the resistance to the cyclic change in the entry angle is improved as compared with the prior art having a fixed apical angle over the length of the stator blade. In particular, the rapid acceleration/deceleration and flow separation at the leading edge end of the negative pressure surface owing to a low momentum region reaching the blade tip can be avoided, and the unsteady flow which would otherwise occur can be avoided (see FIGS. 7*a* and 7*b*). This also prevents the flutter at the leading edge of the tip of the stator blade, and the noises resulting from the interference between the flutter and the flow exiting from the rotor blade can be avoided.

Figure 8:
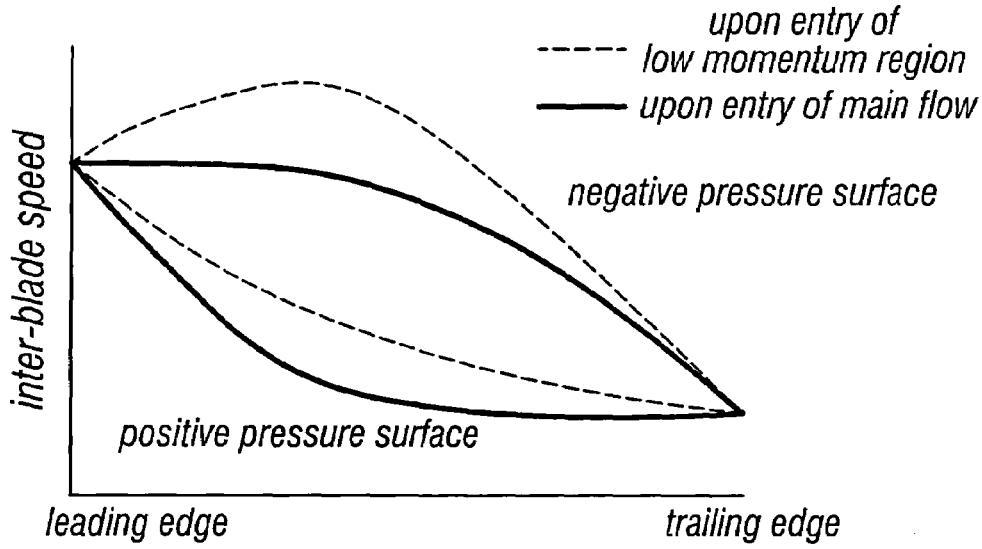
FIG. 8 is a graph showing exemplary distributions of the inter-blade speed at various points on the stator blade according to the prior art and present invention.

By reducing the apical angle of the stator blade at the root thereof, the curvature of the negative pressure surface can be reduced, and the rapid acceleration/deceleration and flow separation on the blade surface can be avoided (see FIG. 8).

Figure 9:
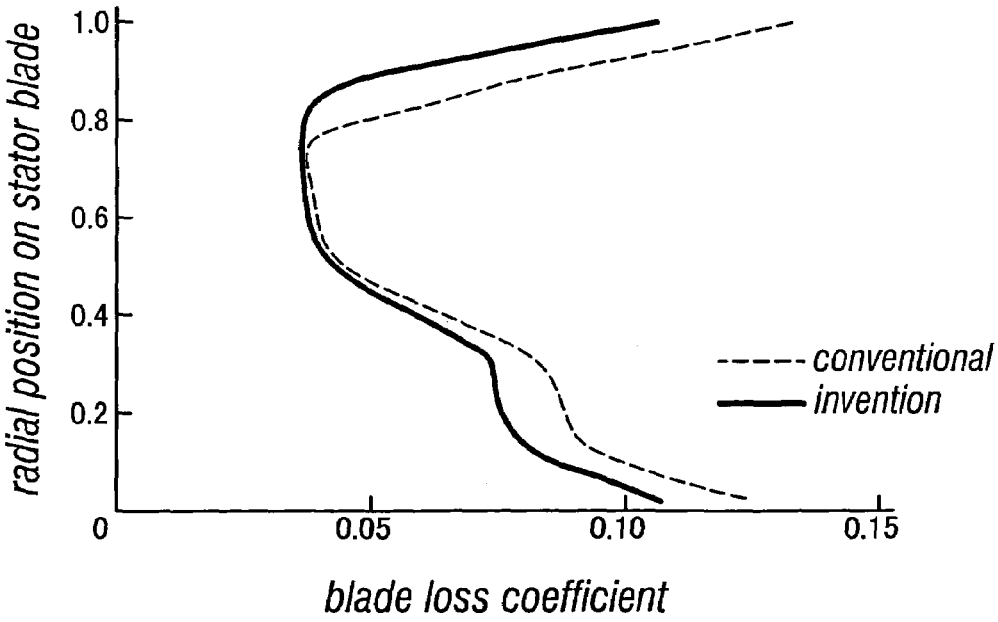
FIG. 9 is a graph showing exemplary distributions of the inter-blade speed at various points on the stator blade according to the prior art and present invention.

By thus improving the inter-blade flow of the stator blade 2, the blade loss was significantly reduced, by approximately 40% at the tip and approximately 15% at the root. The overall reduction in the blade loss was approximately 13% (see FIG. 9).

The optimum apical angle of the leading edge of a stator blade is determined by the entry speed of the compressed air. The optimum apical angle of the leading edge of a stator blade is in the range of approximately 5 to 15 degrees for transonic applications involving a relatively high entry speed, but may be somewhat greater than that, preferably in excess of 25 degrees, in subsonic applications involving a relatively low entry speed.

Although the present invention has been described in terms of preferred embodiments thereof, it is obvious to a person skilled in the art that various alterations and modifications are possible without departing from the scope of the present invention which is set forth in the appended claims.

What is claimed is:

1. A stator blade for an axial flow compressor having a rotor blade immediately upstream of said stator blade, wherein:

an apical angle at a leading edge of said stator blade progressively increases from a root end to a tip of said stator blade, and the apical angle at the tip of said stator blade is 1.5 to 2.5 times of the apical angle at the root of said stator blade.

2. A stator blade for an axial flow compressor according to claim 1, wherein the apical angle is given by $0.5H2+1<\theta'<1.5H+1$, where $\theta'$= (apical angle/apical angle at the root) and H is a nondimensional position on the stator blade as measured from the root thereof.

3. An axial flow compressor according to claim 1, wherein each of said rotor blades is provided with aerofoil section.

4. An axial flow compressor according to claim 1, wherein said compressor is designed as a subsonic axial flow compressor.

5. An axial flow compressor according to claim 4, wherein said apical angle is greater than 25 degrees.

6. A stator blade for an axial flow compressor having a rotor blade immediately upstream of said stator blade, wherein:

an apical angle at a leading edge of said stator blade progressively increases from a root end to a tip of said stator blade, wherein said compressor is designed as a transonic axial flow compressor.

7. An axial flow compressor according to claim 6, wherein said apical angle is between 5 and 15 degrees.

* * * * *